United States Patent [19]

Lapré et al.

[11] Patent Number: 4,999,538

[45] Date of Patent: Mar. 12, 1991

[54] ELECTRIC LAMP INCLUDING ONE-PIECE CONTACT ELEMENTS

[75] Inventors: Marcella A. Lapré, Willemstad, Netherlands Antilles; Winand H. A. M. Friederichs, Eindhoven, Netherlands

[73] Assignee: U.S. Philips Corporation, New York, N.Y.

[21] Appl. No.: 374,517

[22] Filed: Jun. 29, 1989

[30] Foreign Application Priority Data

Jul. 1, 1988 [NL] Netherlands ..... 8801668

[51] Int. Cl.[5] ..... H01J 5/62

[52] U.S. Cl. ..... 313/318; 439/395

[58] Field of Search ..... 313/318; 174/50.52, 174/50.54; 439/395, 396

[56] References Cited

U.S. PATENT DOCUMENTS

| | | | |
|---|---|---|---|
| 4,695,767 | 9/1987 | Wittmann | 313/318 X |
| 4,751,422 | 6/1988 | Morianz et al. | 313/318 |
| 4,836,800 | 6/1989 | Markwardt | 439/395 X |

FOREIGN PATENT DOCUMENTS

| | | |
|---|---|---|
| 3439137 | 5/1986 | Fed. Rep. of Germany . |

*Primary Examiner*—Donald J. Yusko
*Assistant Examiner*—Michael Horabik
*Attorney, Agent, or Firm*—Robert J. Kraus

[57] ABSTRACT

The electric lamp has a printed circuit board (7), on which a supply unit (6) is present. Contact elements (11) are connected to the printed wiring and to current supply conductors (4) to an electric element (3) of the lamp. The contact elements (11) comprise a metal strip provided with two pairs of tongues, which are in contact with the printed wiring and with a current supply conductor, respectively.

3 Claims, 1 Drawing Sheet

ELECTRIC LAMP INCLUDING ONE-PIECE CONTACT ELEMENTS

BACKGROUND OF THE INVENTION

The invention relates to an electric lamp comprising a lamp vessel, which is provided at a first end with an electric element connected to current supply conductors, a housing in which the first end of the lamp vessel is accommodated, a supply unit on a printed circuit board accommodated in the housing, a lamp cap provided with electrical contacts, which are connected to the supply unit, which lamp cap is secured to the housing, contact elements being present, which are electrically connected to the printed wiring and to a respective current supply conductor. Such a lamp is known from DE No 3439137 A1.

In the known lamp, the contact elements are composite members. A first part of a contact element consists of a steel strip bent into the form of a U and provided with resilient tongues, this strip being secured on the printed circuit board by soldering. A second part consists of a metal pin, which is held with clamping fit by the first part. A third part consists of a sleeve, which is formed at the inner surface of the housing. This sleeve accommodates the metal pin. At the end face of the sleeve, a longitudinal slot merges into the sleeve, into which slot a current supply conductor is pulled transversely to the pin so that the sleeve urges said conductor against the pin.

Due to its composite character, the known contact element is expensive. It has further been found that contact elements or parts thereof which are soldered to a printed circuit board often occupy thereon an oblique or rotated position, as a result of which it is more difficult to bring this element or part into contact with a current supply conductor.

SUMMARY OF THE INVENTION

The invention has for its object to provide an electric lamp of the kind describe din the opening paragraph, of which the contact elements are made in one piece and have a simple construction.

In an electric lamp according to the invention, this object is achieved in that the contact elements each consist of a metal strip provided with a first pair of cooperating tongues which holds the printed circuit board with clamping fit and a second pair of cooperating tongues which holds a current supply conductor with clamping fit. The first pair of tongues can be directed in he same sense as or opposite to the second pair. The first pair of tongues can be coplanar with the second pair of tongues or can lie in a plane which encloses an angle to the plane in which the second pair is located.

It is favourable if the tongues of one pair move apart at their free ends. It is then easier to insert the printed circuit board or the current supply conductor with clamping fit between the tongues of the relevant pair. It is also favourable for a good electrical contact if the tongues of the first pair have at their free ends projections facing each other and touching the printed circuit board. It is favourable for the contact with the current supply conductor if the tongues of the second pair enclose between their ends a slot which has the same width throughout its length.

In an embodiment of the lamp according to the invention, the housing accommodates a mounting plate, in which the first end of the lamp vessel is fixed and which has grooves for the contact elements. In a variation of this embodiment, the contact elements themselves have means holding them fixed in the mounting plate, for example barbed hooks at these contact elements or resilient tongues at these elements.

The contact elements may be made of various resilient metals, such as, for example, of phosphor bronze, new silver and resilient steel.

The electric lamp may be, for example, a low-pressure discharge lamp, for example a fluorescent lamp. The lamp may have a folded discharge track, the lamp vessel being bent one or several times or parallel tubes being connected in series with each other. The electric element is then a pair of electrodes in the lamp vessel. However, the lamp may alternatively be a discharge lamp, in which the electric element is an electric coil around a magnetizable core, for example a low-pressure fluorescent lamp.

BRIEF DESCRIPTION OF THE DRAWINGS

An embodiment of the lamp according to the invention and embodiments of contact elements for this lamp are shown in the drawing.

In the drawing.

DESCRIPTION OF THE PREFERRED EMBODIMENTS

Figure 1:
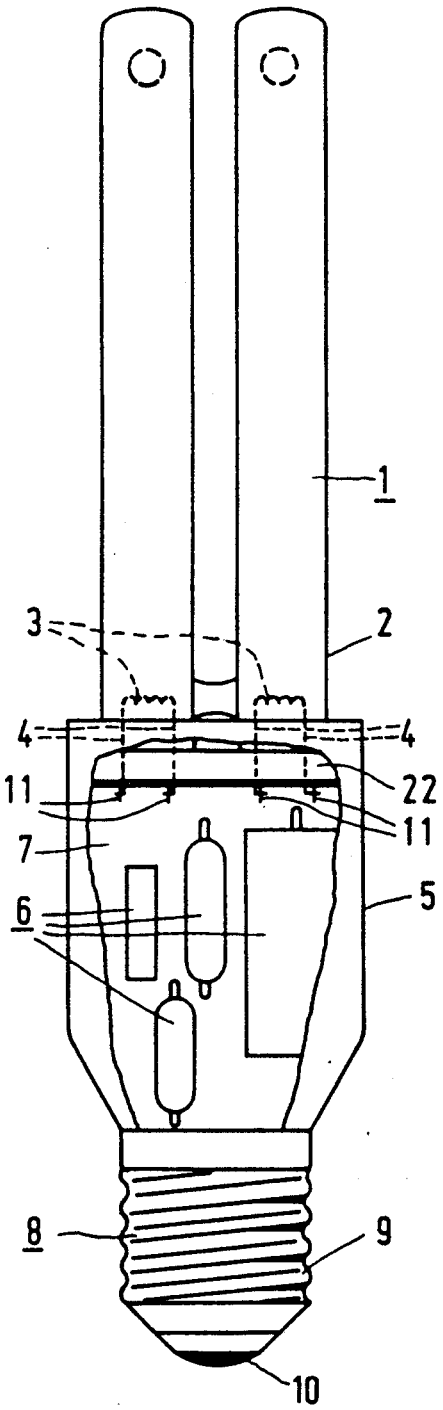
FIG. 1 is a side elevation of an embodiment of the lamp, in which the housing is broken away.

The electric lamp of FIG. 1 has a lamp vessel 1, which is provided at a first end 2 with an electric element 3, which is connected to current supply conductors 4. In the lamp shown the electric element 3 is a pair of electrodes of a low-pressure mercury fluorescent lamp. The lamp vessel 1 comprises four series-connected tube portions. The lamp has a housing 5, in which the first end 2 of the lamp vessel 1 is accommodated. A supply unit 6 on a printed circuit board 7 is accommodated in the housing 5. A lamp cap 8 provided with electrical contacts 9, 10, which are connected to the supply unit 6, is secured to the housing 5. Contact elements 11 are present, which are electrically connected to the printed wiring of the board 7 and to a respective current supply conductor 4. The lamp shown has a mounting plate 22, in which the first end of the lamp vessel 1 and the contact elements 11 are fixed.

Figure 2:
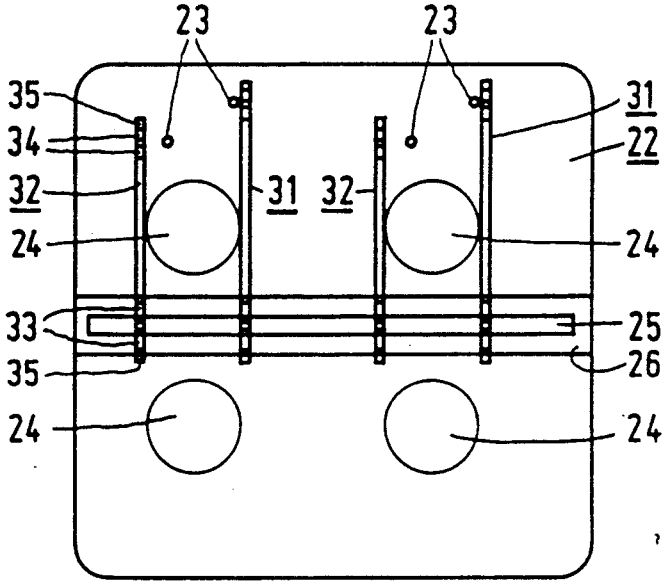
FIG. 2 shows the mounting plate of FIG. 1 provided with contact elements in a bottom view.

The mounting plate 22 of FIG. 2 has bores 23, through each of which a current supply conductor can be passed. The mounting plate 22 further has bores 24, in which the first end of a lamp vessel can be fixed, and a slot 25 in an embossed part 26, in which a printed circuit board is arranged. Contact elements 31 and 32 are fixed in the grooves in the plate 22. The contact elements 31 have a greater length than the contact elements 32, but are otherwise identical and also similar to the contact elements 11 of FIG. 1.

Figure 3:
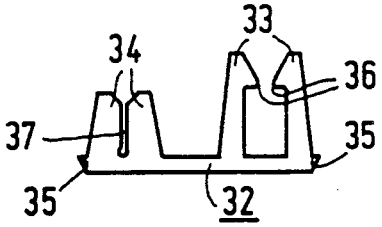
FIG. 3 is a side elevation of a contact element of FIG. 2.

As appears from FIG. 3, the contact element 32 consists of a metal strip provided with a first pair of cooperating tongues 33 and a second pair of cooperating tongues 34. The first pair of cooperating tongues 33 is located in the slot 25 (FIG. 2) in order that the printed circuit board to be arranged therein can be held with clamping fit. The second pair of cooperating tongues 34 is located near a bore 23 in order that a current supply conductor to be passed through it can be held with clamping fit. The contact element fixed in a mounting plate 22 (FIG. 2). The first tongues 33 have near their free ends facing projections 36. The tongues 33 move apart at their free ends facing projections 36. The tongues 33 move apart at their free ends so that a printed circuit board can be readily accommodated and have at the area of the projections 36 a discrete contact point to make electrical contact with the printed wiring of a board. The tongues 34 also move apart at their free ends so that a current supply conductor can readily be accommodated, but enclose between their ends a slot 37 having substantially the same width throughout its length so that it is not important at which point a current supply conductor is held in the slot.

Figure 4:
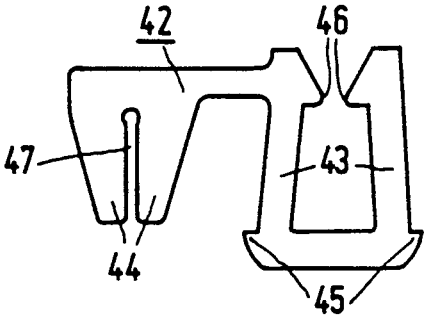
FIG. 4 shows a variation of FIG. 3.

In FIG. 4, parts corresponding to the contact element of FIG. 3 have a reference numeral which is 10 higher than in FIG. 3.

With the use of the contact element 32 in a mounting plate 22, the contact element is first arranged in the mounting plate and then current supply conductors are arranged in the contact element between the tongues 34, which, like the tongues 33, project above the surface of the board.

With the use of the contact element 42, a current supply conductor is disposed over the relevant surface of the mounting plate 22 and, when the contact element is provided, at the same time contact is established with a current supply conductor. The free ends of the tongues 44 are then located in the mounting plate.

The strips 32 and 42 may be bent, as a result of which the tongues 33, 43 are located in a plane which is, for example, at right angles to the plane in which the tongues 34 and 44, respectively, are located.

We claim:

1. An electric lamp comprising a lamp vessel which is provided at a first end with an electric element connected to current supply conductors, a housing in which the first end of the lamp vessel is accommodated, a supply unit on a printed circuit board accommodated in the housing, a lamp cap provided with electrical contacts connected to the supply unit, which lamp cap is secured to the housing, contact elements being present, which are electrically connected to the printed circuit board and to a respective current supply conductor, characterized in that the contact elements each consist of a metal strip provided with a first pair of cooperating tongues, which holds the printed circuit board with clamping fit, and a second pair of cooperating tongues, which holds a current supply conductor with clamping fit.

2. An electric lamp as claimed in claim 1, characterized in that the housing accommodates a mounting plate, in which the first end of the lamp vessel is fixed and in which grooves are provided, in which the contact elements are accommodated.

3. An electric lamp as claimed in claim 2, characterized in that the contact elements have means which hold them fixed in the grooves.

* * * * *